US005463888A

United States Patent [19]

Nagai

[11] Patent Number: 5,463,888

[45] Date of Patent: Nov. 7, 1995

[54] TUBE BENDING APPARATUS AND METHOD

[75] Inventor: Masayuki Nagai, Suita, Japan

[73] Assignee: Sumitomo Metal Industries, Ltd., Osaka, Japan

[21] Appl. No.: 214,147

[22] Filed: Mar. 16, 1994

[30] Foreign Application Priority Data

Feb. 15, 1994 [JP] Japan ..... 6-041983

[51] Int. Cl.[6] ..... B21D 7/04; B21D 7/02

[52] U.S. Cl. ..... 72/157; 72/217; 72/465; 72/369

[58] Field of Search ..... 72/157, 158, 217, 72/369, 387, 388, 465

[56] References Cited

U.S. PATENT DOCUMENTS

| | | | |
|---|---|---|---|
| 3,545,247 | 10/1968 | Fazzani | 72/310 |
| 3,878,720 | 4/1975 | Stange et al. | 72/310 |
| 3,958,440 | 5/1976 | Sassak | 72/307 |
| 4,052,878 | 10/1977 | Connelly | 72/293 |
| 4,522,055 | 6/1985 | Berger | 72/477 |
| 4,798,073 | 1/1989 | Dischler | 72/218 |
| 4,890,469 | 1/1990 | Dischler | 72/218 |
| 5,072,786 | 12/1991 | Wachter | 165/69 |
| 5,125,252 | 6/1992 | Ayers et al. | 72/157 |
| 5,127,248 | 7/1992 | Sanseau | 72/149 |

FOREIGN PATENT DOCUMENTS

| | | |
|---|---|---|
| 0186957 | 7/1986 | European Pat. Off. . |
| 2558933 | 8/1875 | France . |
| 2626486 | 5/1977 | Germany . |
| 3151236 | 7/1983 | Germany . |
| 8705643 | 8/1987 | Germany . |
| 50-29465 | 3/1975 | Japan . |
| 58-159923 | 9/1983 | Japan . |
| 58-159924 | 9/1983 | Japan . |
| 58-185324 | 12/1983 | Japan . |
| 62-187524 | 8/1987 | Japan . |
| 4-224024 | 8/1992 | Japan . |

*Primary Examiner*—Lowell A. Larson
*Assistant Examiner*—Rodney Butler
*Attorney, Agent, or Firm*—Burns, Doane, Swecker & Mathis

[57] ABSTRACT

A heat exchanger is disclosed, which comprises: a plurality of tubes each having a U-shaped portion and arranged in a plurality of parallel bending planes, each bending plane containing a plurality of tubes of the same nominal outer diameter and of differing bending radius, the variation of the outer diameter of the tubes in at least one of the bending planes measured in a direction perpendicular to the bending planes being at most 0.1 mm; and an antivibration bar disposed between two of the bending planes.

7 Claims, 15 Drawing Sheets

Fig. 1(A)
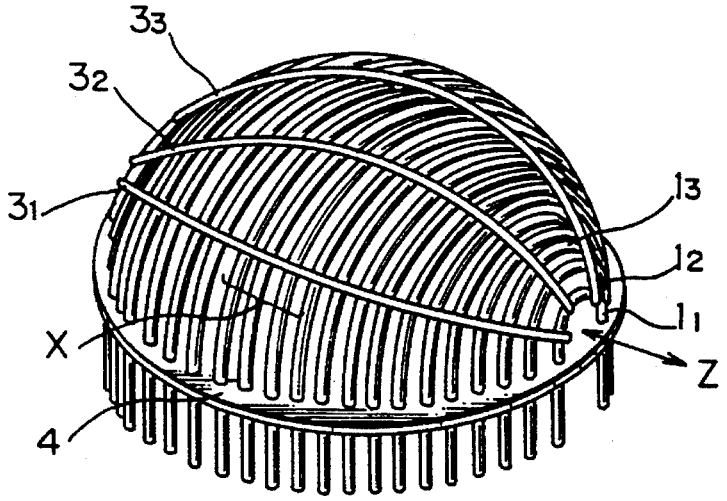
Fig. 1(B)
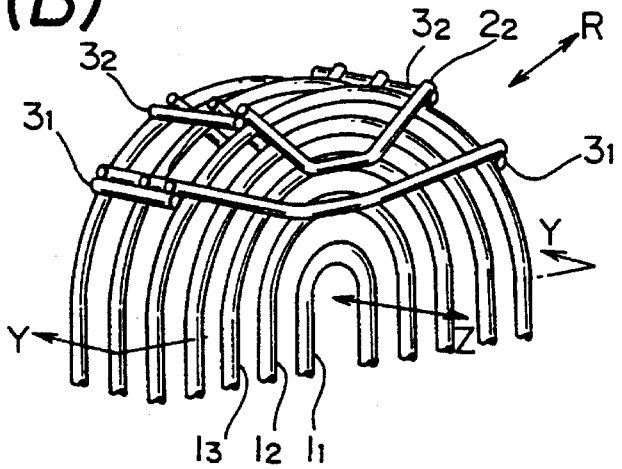
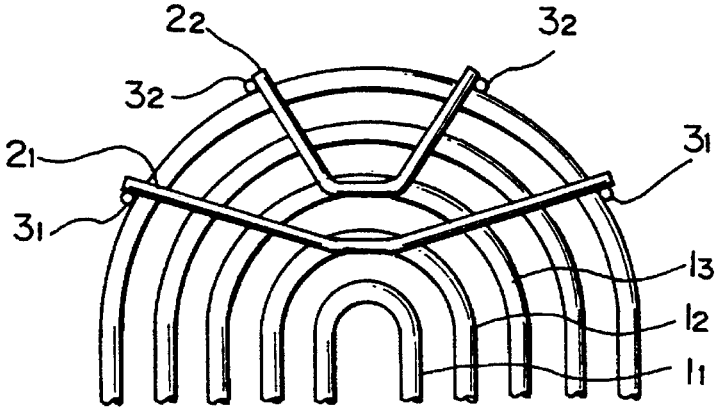
Fig. 1(C)

Fig. 10(A)
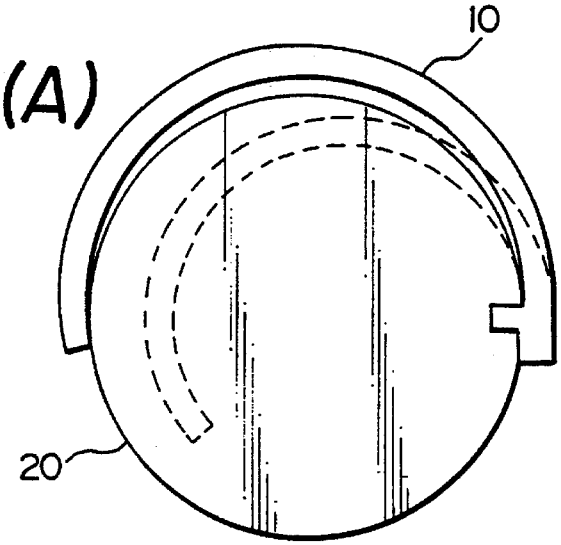
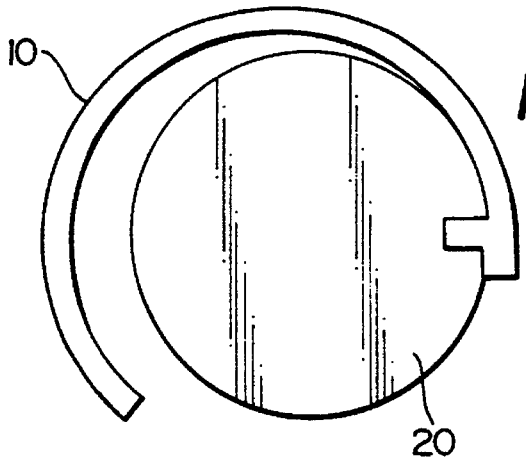
Fig. 10(B)

Fig. 11(A)
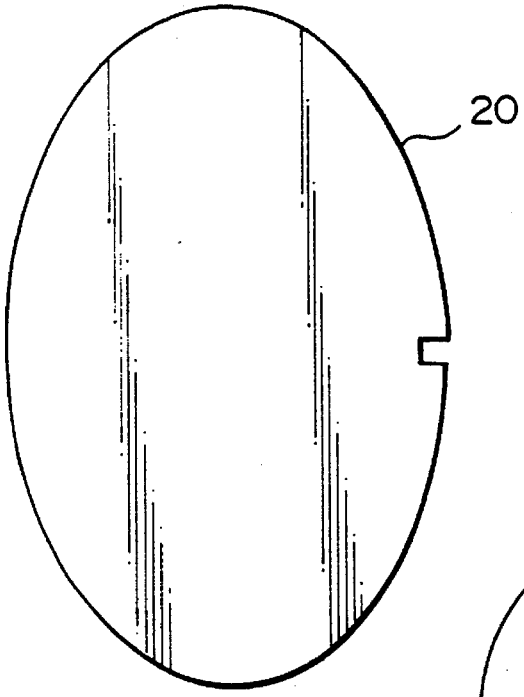
Fig. 11(B)
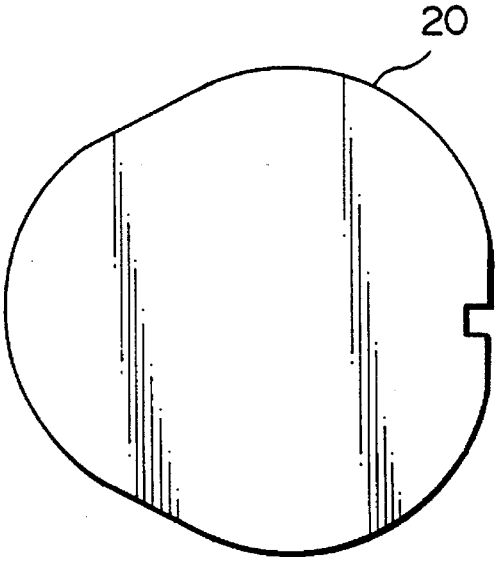
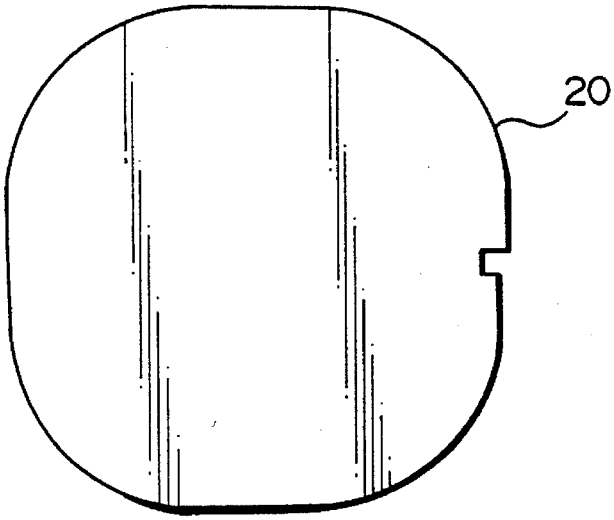
Fig. 11(C)

TUBE BENDING APPARATUS AND METHOD

BACKGROUND OF THE INVENTION

This invention relates to an apparatus and method for bending tubular stock into the shape of a U to form heat transfer tubes suitable for use in a heat exchanger. More particularly but not exclusively, it relates to an apparatus and method capable of forming U-shaped heat transfer tubes for use in a heat exchanger of a pressurized water reactor. It also relates to a heat exchanger employing such tubes.

A steam generator in a heat exchanger for a pressurized water reactor comprises an array of heat transfer tubes formed from a plurality of U-shaped tubes (referred to below as U-bend tubes) of differing bending radius.

FIGS. 1A–1C schematically illustrate an array of heat transfer tubes, and FIGS. 2A and 2B are plan views of support plates for heat transfer tubes.

As shown in FIG. 1A, the upper portions of the heat transfer tubes generally form a hemisphere. On the innermost portion of the hemisphere, a plurality of U-bend tubes $\mathbf{1}_1$, $\mathbf{1}_1$, . . . having the smallest bending radius are spaced at equal intervals along a Z axis, which is perpendicular to the bending planes of the tubes $\mathbf{1}_1$, $\mathbf{1}_1$, . . . . On the outside of tubes $\mathbf{1}_1$, $\mathbf{1}_1$, . . . are arranged a plurality of U-bend tubes $\mathbf{1}_2$, $\mathbf{1}_2$, . . . , U-bend tubes $\mathbf{1}_3$, $\mathbf{1}_3$, . . . , etc. of successively larger bending radius. These tubes having the same bending radius, like tubes $\mathbf{1}_1$, are spaced at equal intervals in the Z direction. The spacing between the larger radius tubes $\mathbf{1}_2$, $\mathbf{1}_3$, etc. in the Z direction is the same as between the smallest radius tubes $\mathbf{1}_1$.

FIGS. 2A and 2B illustrate two conventional arrangements of U-bend tubes in a steam generator. The arrangement of FIG. 2A is referred to as a rectangular array, while the arrangement of FIG. 2B is referred to as a triangular array. In the rectangular array, tubes of successively larger bending radius are disposed in the same bending plane. For example, in FIG. 2A, tubes $\mathbf{1}_1$–$\mathbf{1}_5$ all lie in a common bending plane. In the triangular array, tubes of successively larger bending radius are disposed in bending planes which are staggered from one another. Thus, in FIG. 2B, tubes $\mathbf{1}_1$, $\mathbf{1}_3$, $\mathbf{1}_5$, and $\mathbf{1}_7$ lie in a first bending plane, while tubes $\mathbf{1}_2$, $\mathbf{1}_4$, and $\mathbf{1}_6$ lie in a second bending plane spaced midway between two of the first bending planes.

In either arrangement, the number of tubes progressively increases from the ends of the array in the Z direction towards the center. Below the hemispherical portion, the tubes extend straight downwards.

Namely, a first series of U-bend tubes of a first nominal bending radius is arranged in a row with the U-bends aligned in the Z direction. Then, a second series of U-bend tubes smaller in number than the first series of tubes and each having a second nominal bending radius which is larger than the first nominal bending radius is arranged in a row with the U-bends of the second series of tubes aligned in the Z direction. Each of the U-bends of the second series of tubes is concentric with respect to one of the U-bends of the first series of tubes. Subsequent series of U-bend tubes are arranged in a similar manner, with the number of tubes in each series decreasing and the nominal bending diameter increasing as the distance from the first series of tubes increases. In this manner, a hemispherical portion is formed at the top portion of an assembly of the U-bend tubes.

A steam generator of this type commonly employs more than 100 different types of tubes $\mathbf{1}_1$, $\mathbf{1}_2$, . . . , etc. of differing bending radius. Therefore, at the center of the array in Z direction, more than 100 different U-bend tubes are concentrically arranged in the same bending plane. See FIG. 1C. The total number of tubes in a steam generator of this type may be more than 7000.

In a steam generator of a heat exchanger for a pressurized water reactor, it is extremely important to secure the heat transfer tubes to prevent them from being damaged. For this reason, as shown in FIG. 1A, a plurality of levels of support plates 4 are used to secure the straight portions of the tubes except the hemispherical portion. However, it is impossible for the support plates 4 to secure the tubes in the hemispherical portion, so V-shaped antivibration bars 2 are inserted into the gaps between adjacent bending planes to secure the bending portions of the tubes, except for the tubes having smaller bending radius, since these tubes do not project far above the support plate 4 and so are relatively stiff.

For example, at the center of the hemispherical portion in the Z direction, a plurality of antivibration bars $\mathbf{2}_1$, $\mathbf{2}_2$, etc. are disposed at different levels. The antivibration bars 2 are typically metal bars having a rectangular cross section. The outer ends of the antivibration bars 2 are secured by holders $\mathbf{3}_1$, $\mathbf{3}_2$, etc. which extend in curves along the surface of the hemispherical portion.

The U-bends of heat transfer tubes of this type must have a high dimensional accuracy. Therefore, they are frequently manufactured by a bending process employing a die. Two tube bending methods using a die are rotary draw bending, illustrated in FIG. 3A, and compression bending, illustrated in FIG. 3B.

In rotary draw bending, as shown in FIG. 3A, a bending die and a clamp 6 for securing a workpiece W on the bending die 5 are employed. A groove corresponding to the external shape of the workpiece W is formed in the peripheral surface of the bending die 5. A groove corresponding to the external shape of the workpiece W is also formed in the clamp 6.

The workpiece W is grasped between the bending die 5 and the clamp 6, and in this state, the bending die 5 and the clamp 6 are synchronously rotated about the center of the bending die 5. As a result, the workpiece W is pressed into the groove of the bending die 5 and is suitably bent. At this time, the clamp 6 draws the workpiece W to move it in its axial direction, and thus it is called "rotary draw bending".

In compression bending, as shown in FIG. 3B, a roller 7 is used instead of a clamp 6. A groove corresponding to the external shape of the workpiece W is formed in the roller 7 around its entire circumference. With the workpiece W held between the bending die 5 and the roller 7, the roller 7 is rolled around the periphery of the bending die 5, and the workpiece W is pressed into the groove of the bending die 5.

Many methods of tube bending have been proposed (see Japanese Published Unexamined Patent Application Nos. 50-29465, 58-159923, and 58-159924 and Japanese Published Unexamined Utility Model Application No. 58-185324, for example). Of these methods, those employing a die can all be classified as either rotary draw bending or compression bending.

SUMMARY OF THE INVENTION

Conventional bending methods using a bending die employ a different die for each bending radius so that a bend of high dimensional accuracy can be obtained. However, as described above, a heat exchanger for a pressurized water reactor may require over 100 different types of tubes, each having a different bending radius. Therefore, if conventional bending methods are used to manufacture such tubes, over 100 different bending dies are necessary, making these methods extremely uneconomical. This is because the grooves of the bending die must be manufactured with extremely high accuracy, so if a large number of different dies are required, equipment costs are high, and the resulting tubes become expensive.

During manufacture of bending dies, some errors in the shape of the die grooves are inevitable. Furthermore, after repeated use, variation in the groove dimensions occur due to different amounts of wear among the dies. In addition, the smaller the bending radius of a tube, the more the outer diameter of the tube measured in the Z direction perpendicular to the bending plane exceeds the groove diameter of the die used to bend the tubes.

Due to a combination of these factors, in the hemispherical portion of a heat exchanger, the tube outer diameter in the Z direction of the tubes varies among tubes of different bending radius.

This condition in a rectangular array of tubes is illustrated in FIG. 4, which is a cross-sectional view of tubes in adjoining bending planes. An antivibration bar 2 is disposed in the space between the tubes of adjoining bending planes in order to support them. The antivibration bar 2 has a thickness T, which can be no greater than the minimum value of the distance $d_n$, $d_{n+1}$, . . . between corresponding tubes in adjoining bending planes. This distance d is a function of the tube diameter $D_n$, $D_{n+1}$, . . . in the Z direction.

If the maintenance of the grooves of the bending dies is poor, the variation of the tube outer diameter D among the tubes may be as large as about 0.3 mm, and the distance d between corresponding tubes will vary by the same amount among the tubes. Therefore, when the antivibration bar 2 is inserted between the tubes, large gaps will exist between the antivibration bar 2 and the tubes having a smaller outer diameter D than the other tubes, so these tubes can not be properly supported by the antivibration bar 2. The same phenomenon occurs with tubes arranged in a triangular array.

Since the amount of movement possible by the tubes is at most 0.3 mm, the gaps between the tubes and the antivibration bar 2 do not directly affect the safety of the heat exchanger. However, an even higher degree of safety can be achieved by further reducing the amount of clearance between the antivibration bar 2 and the tubes.

A heat exchanger according to one form of the present invention comprises a plurality of tubes each having a U-shaped portion and arranged in a plurality of parallel bending planes, and an antivibration bar disposed between two of the bending planes. Each bending plane contains a plurality of tubes of the same nominal outer diameter and of differing bending radius. The variation of the outer diameter of the tubes in at least one of the bending planes measured in a direction perpendicular to the bending planes is at most 0.1 mm.

A heat exchanger according to another form of the present invention comprises a plurality of tubes each having a U-shaped portion and arranged in a plurality of parallel bending planes, and an antivibration bar disposed between two of the bending planes. Each bending plane contains a plurality of tubes of the same nominal outer diameter and of differing bending radius. The tubes in each bending plane are divided into a plurality of groups according to the bending radii of the tubes and include an inner group and an outer group with the bending radii of the tubes increasing from the inner group to the outer group. The outer diameter of the tubes measured in a direction perpendicular to the bending planes decreases from the inner group to the outer group in each bending plane. The variation of the outer diameters of the tubes within each group in at least one of the bending planes is at most 0.1 mm.

A tube bending method according to one form of the present invention comprises deforming an elastic ring die to a plurality of different bending radii, the ring die having a portion missing from its circumference enabling elastic radial deformation and a circumferentially extending bending groove having a cross section with a diameter and a shape corresponding to an external shape of a tube to be bent. A different tube is bent around the ring die at each bending radius to form a U-shaped portion in each tube, wherein the groove diameter of the ring die is at least the nominal outer diameter $D_0$ of the tube being bent and at most $D_0$+0.1 mm.

A tube bending according to another form of the present invention comprises preparing a plurality of flexible dies of differing basic radius, each die each having a section missing in its periphery permitting radial elastic deformation and having a die groove extending in a circumferential direction of its outer periphery, the die groove having a cross-sectional shape corresponding to an external shape of a tube to be bent, the groove diameter decreasing as the basic radius of the ring dies increases. At least one of the ring dies is deformed to a plurality of different bending radii. A different tube is bent around the deformed ring die at each bending radius to form a U-shaped portion in the tube, wherein the groove diameter is at least the nominal outer diameter $D_0$ of the tube being bent and at most $D_0$+0.1 mm when the bending radius R of the tube $\geqq D_0 \times 80$.

A tube bending apparatus according to the present invention comprises:

a flexible ring die having a section missing from its periphery and a die groove extending circumferentially along its outer periphery and having a cross-sectional shape corresponding to an external shape of a tube to be bent; and a holder for releasably holding the ring die on an outer periphery of the holder.

In another embodiment of the present invention, the tube bending apparatus comprises:

a holder having a generally conical portion and a helical external thread formed on an outer surface of the conical portion;

means for moving the holder in an axial direction and a circumferential direction of the holder;

a ring die having a portion missing from its circumference to permit radial expansion and contraction of the ring die and having an internal thread for engagement with the external thread of the holder, and a groove formed in an outer periphery of the ring die and extending in a circumferential direction of the ring die, the groove having a cross section corresponding to an external shape of a tube to be bent; and a clamping head having a groove opposing the groove in the ring die, the head being movable in the radial direction of the holder to releasably clamp a tube to be bent between the groove in the ring die and the groove-in the head and movable in the circumferential direction of the holder to wrap a tube to be bent around the groove in the ring die.

BRIEF DESCRIPTION OF THE DRAWINGS

FIGS. 1A–1C are schematic views of heat transfer tubes used in a steam generator of a pressurized water reactor.

FIGS. 10A and 10B are schematic plan views illustrating the situation when one end of a ring die is not secured.

FIGS. 11A–11C are plan views of various examples of disk-shaped holders which can be used in the present invention.

DESCRIPTION OF PREFERRED EMBODIMENTS

Figure 5A:
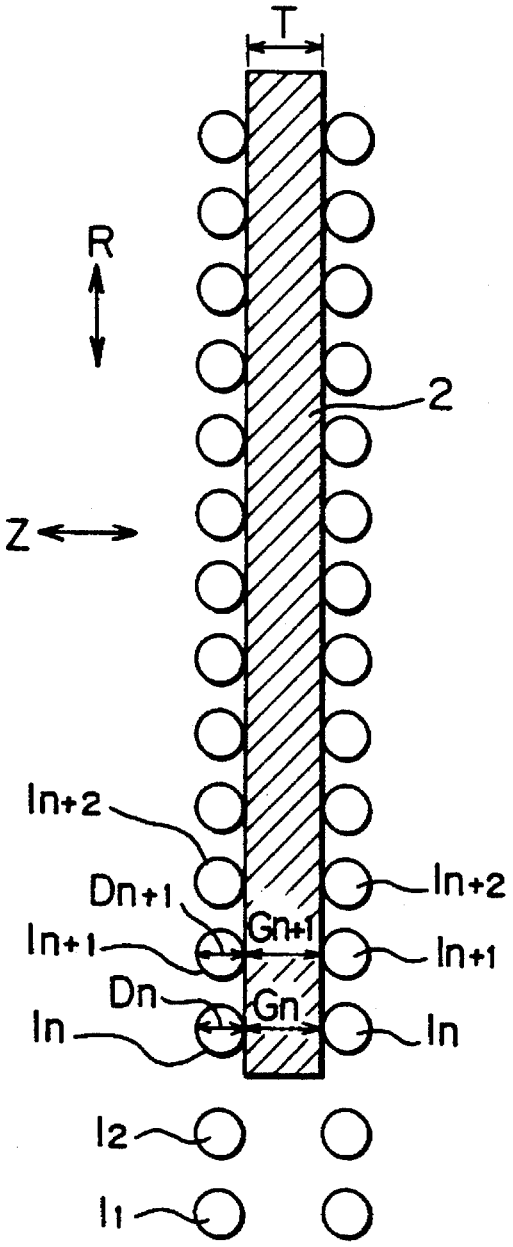
FIGS. 5A and 5B are schematic cross-sectional views of heat transfer tubes in a heat exchanger according to the present invention.

FIG. 5A schematically illustrates the heat transfer tubes of a first embodiment of a heat exchanger according to this invention. In this embodiment, the tubes are arranged in a rectangular array.

The heat exchanger includes a plurality of U-bend tubes $\mathbf{1}_1$, $\mathbf{1}_2$, etc. of different bending radius. The tubes are disposed at equal intervals both in the Z direction, i.e., the direction perpendicular to the bending planes, and in the radial direction R parallel to the bending planes. An antivibration bar 2 is inserted in the space formed between adjoining bending planes and extends from the outside towards the inside of the heat exchanger without reaching the tubes having the smaller bending radius.

Where the antivibration bar 2 is located, the outer diameters $D_n$, $D_{n+1}$, etc. of the tubes measured in the Z direction perpendicular to the bending planes vary by at most 0.1 mm between the tube having the smallest bending radius and the tube having the largest bending radius. For this reason, the distance $G_n$, $G_{n+1}$, etc. between corresponding tubes in adjoining bending planes varies by at most 0.1 mm from the inside to the outside. Accordingly, all of the tubes can be reliably supported by an antivibration bar 2 having a constant thickness T from the inside to the outside.

Figure 5B:
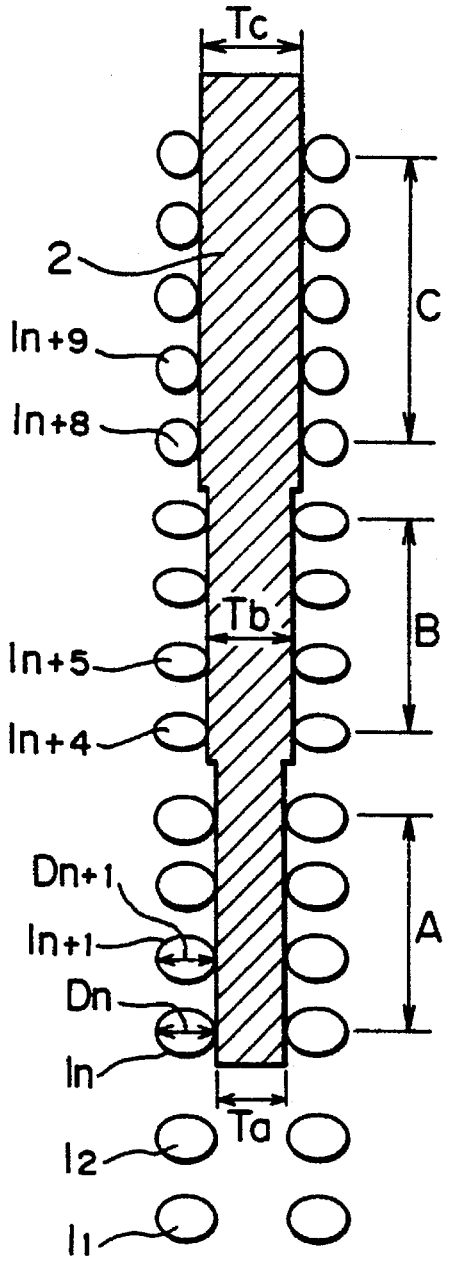

FIG. 5B schematically illustrates the heat transfer tubes of a second embodiment of a heat exchanger according to the present invention. The tubes are again arranged in a rectangular array. An antivibration bar 2 is inserted between a plurality of types of U-bend tubes $\mathbf{1}_n$, $\mathbf{1}_{n+1}$, etc. of differing bending radius. The tubes are divided into a plurality of groups A, B, etc. according to their bending radius. The outer diameter $D_n$, $D_{n+1}$, etc. of the tubes measured in the Z direction decreases in a stepwise manner group by group as the bending radius of the tubes increases. Namely, the maximum outer diameters D of the tubes in group A are larger than those in group B, and the outer diameters D of the tubes in group B are larger than those in group C. In a single group, the variation of the outer diameters D of the tubes is at most 0.1 mm.

The distance G between corresponding tubes in adjoining bending planes on opposite sides of the antivibration bar 2 increases in a stepwise manner from group A on the inside towards group C on the outside. Therefore, the antivibration bar 2 is formed with a thickness T which increases in a stepwise manner from Ta in group A to Tc in group C.

Because the thickness of the antivibration bar 2 decreases towards its inner end, it can be readily inserted between the tubes in adjoining bending planes from the outer periphery of the heat exchanger. The variation in the outer diameters D measured in the Z direction of the tubes in a single group is limited to at most 0.1 mm, so the antivibration bar 2 can limit the vibration of the tubes in each group to an extremely low level.

Figure 6A:
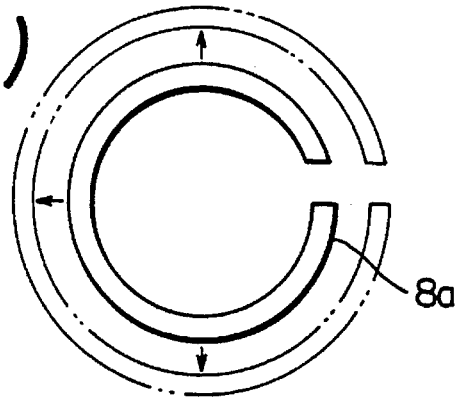
FIGS. 6A–6C are schematic plan views of ring dies used in a tube bending method according to the present invention.
Figure 6B:
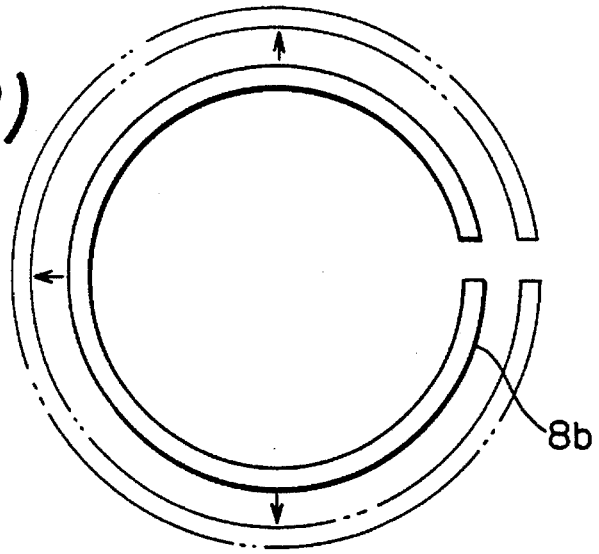
Figure 6C:
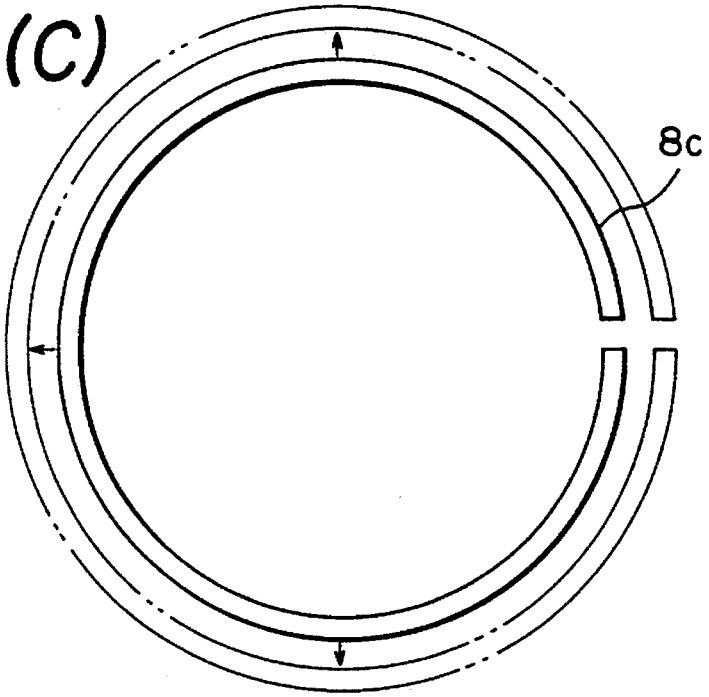

FIGS. 6A–6C illustrate ring dies used in a bending method according to the present invention. A plurality of ring dies **8*a*, 8*b***, etc. of differing basic radius are employed. Each die is made of a flexible material, and a portion of the circumference is missing so that the die can elastically deform in its radial direction. A groove corresponding to the outer shape of a workpiece, i.e., of a tube to be bent is formed in the outer periphery of each die. Accordingly, a single ring die can be used to bend tubes of differing bending radii.

Ring die **8*a* with a small basic radius can be deformed to various radii to form tubes $\mathbf{1}_n$ to $\mathbf{1}_{n+3}$ in group A having a small bending radius. Ring die 8*b* having an intermediate bending radius is deformed to various radii to form tubes $\mathbf{1}_{n+4}$ to $\mathbf{1}_{n+7}$ in group B having an intermediate bending radius. Furthermore, ring die 8*c*** having a large basic radius is deformed to various radii to form tubes $\mathbf{1}_{n+8}$ to $\mathbf{1}_{n+12}$ in group C having a large bending radius.

In the bending method according to the present invention, the number of ring dies used to form tubes having different bending radii is greatly reduced, so the dimensions of the die grooves can be carefully maintained. Furthermore, the same ring die can be used for all the tubes in a group, so the variation among the tubes in a group of the outer diameter D measured in the Z direction can be suppressed to a low value. In addition, since the dimensions of the die grooves can be carefully maintained, the outer diameters D can be controlled to a desired value.

In a first form of the bending method according to the present invention, the groove diameter of the ring dies is at least $D_0$ and at most $D_0$+0.1 mm, wherein $D_0$ is the nominal outer diameter of the tube being bent.

If the groove diameter is more than $D_0$, the tube may be pressed into the die groove without being crushed. In order to prevent scratching of the tube when pressed into the groove, the diameter of the groove is preferably at least $D_0$+0.02 mm. The upper limit on the groove diameter is set at $D_0$+0.1 mm so that the variation of the tube outer diameter D measured in the Z direction will be at most 0.1 mm.

As stated earlier, the smaller the bending radius, the larger is the difference between the tube outer diameter D measured in the Z direction and the diameter of the die groove. Therefore, the ring die used to manufacture the tubes in a group having the smallest bending radius has a maximum groove diameter, and the ring die used to manufacture the tubes in another group having a smaller bending radius has a groove diameter with an upper limit which is decreased from the above-described maximum by the amount by which the tube outer diameter D is increased. The amount by which the tube outer diameter D is increased depends upon characteristics of the tube to be bent such as its dimensions, strength, and bending radius, but as an example, for a tube made of Alloy 690 (trademark for a product of Inco Corporation) having a nominal outer diameter of 17.40 mm and a wall thickness of 1.02 mm to be bent by rotary draw bending, when the bending radius is 520 mm, then the amount of increase is about 0.02 mm, and it is approximately 0 when the bending radius is 886 mm or higher.

Thus, if the groove diameter of the ring dies is at least $D_0$ and at most $D_0$+0.1 mm, taking into consideration the above-described increase in the tube outer diameter, the variation in the tube outer diameter measured in the Z direction can be restricted to at most 0.1 mm.

In order to limit the variation in tube outer diameter to an even lower value according to a preferred embodiment of the present invention, the groove diameter can be selected in the following manner.

(1) The maximum values $\Delta D_1$, $\Delta D_2$, $\Delta D_3$, etc. for the increase in tube outer diameter for each group of U-bend tubes manufactured using the ring dies are investigated in advance, wherein $\Delta D_1$ is the value for the group having the smallest basic radius, and $\Delta D_2$, $\Delta D_3$, etc. are values for groups of successively larger basic radius.

(2) The groove diameter $M_1$ for the ring die having the smallest basic radius is set to approximately the above-described preferred lower limit of $D_0$+0.02 mm. From a practical view point, the upper limit may be restricted to $M_1=D_0+\Delta_1$.

(3) The groove diameters $M_2$, $M_3$, etc. for the ring dies of successively larger basic radius are determined by the following formulas.

$$M_2 = M_1 + (\Delta D_1 - \Delta D_2)$$
$$M_3 = M_1 + (\Delta D_1 - \Delta D_3)$$
$$\cdots$$
$$M_n = M_1 + (\Delta D_1 - \Delta D_n)$$

In this manner, the maximum value of the tube outer diameter measured in the Z direction can be approximately the same for each group.

In other words, the maximum value is $(D_0+0.02+6\Delta D_1)$ mm, so the variation of the tube outer diameter for all the tubes can be limited to at most $(0.02+\Delta D_1)$ mm, and it is possible for an antivibration bar having a constant thickness over its entire length to function effectively.

In still another embodiment of the present invention, the groove diameter is at most $D_0$+0.1 mm—(tube outer diameter after bending—groove diameter).

According to a second form of a bending method according to the present invention, the groove diameter of a plurality of different ring dies decreases in a stepwise manner as the basic radius increases. Furthermore, for the ring dies used for the groups of tubes for which $R/D_0 \geqq 80$, wherein R is the bending radius, the groove diameter is made at least $D_0$ and at most $D_0$+ 0.1 mm.

If the groove diameter is more than $D_0$, the tube may be pressed into the die groove without being crushed. In order to prevent scratching of the tube when it is pressed into the groove, the diameter of the groove is preferably at least $D_0$+ 0.02 mm. For U-bend tubes to be used in heat exchangers, the ratio $t/D_0$, wherein t is the wall thickness of the tubes, is normally approximately 5% (4%–7%). If $t/D_0$ is of this order, the tendency for the tubes to become elliptical is small when $R/D_0 \geqq 80$, and portions of the tube do not fill the die groove, so the variation among the tubes in the outer diameter measured in the Z direction increases. If the upper limit on the groove diameter is set at $D_0$+0.1 mm, failure of the tubes to fill the grooves in the dies is suppressed, and the variation in the tube outer diameter can be limited to at most 0.1 mm. Therefore, the maximum value of the groove diameter decreases in a regular stepwise manner from groups having a small bending radius to groups having a large bending radius, so an antivibration bar which decreases in thickness in a stepwise manner towards its inner end can be effectively employed.

When the bending radius R is smaller than $R_0 \times 80$ and the tube outer diameter after bending is greater than the groove diameter, the before-mentioned bending method can be repeated.

Figure 7:
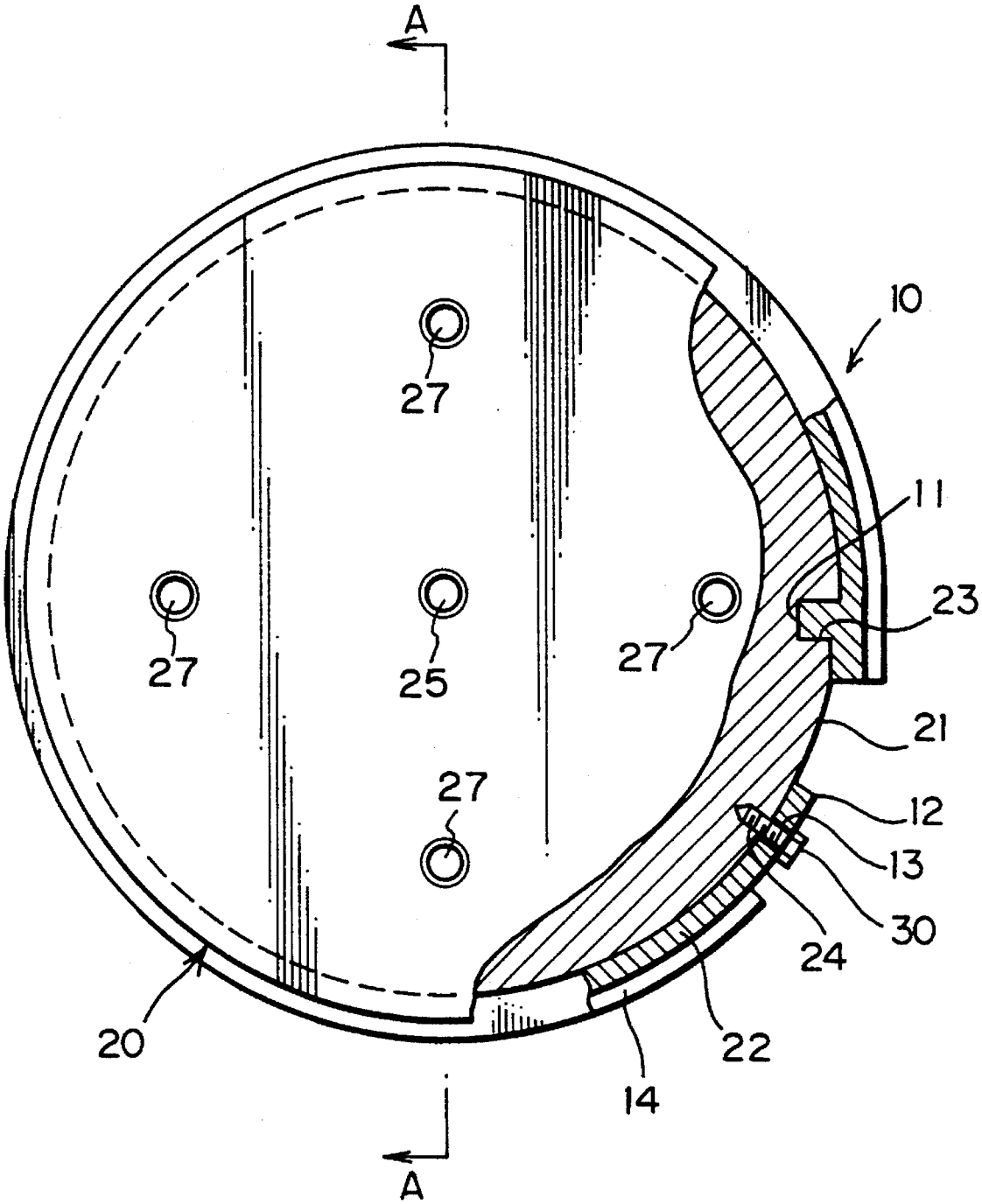
FIG. 7 is a plan view of an example of a bending die used in the method of the present invention.
Figure 8:
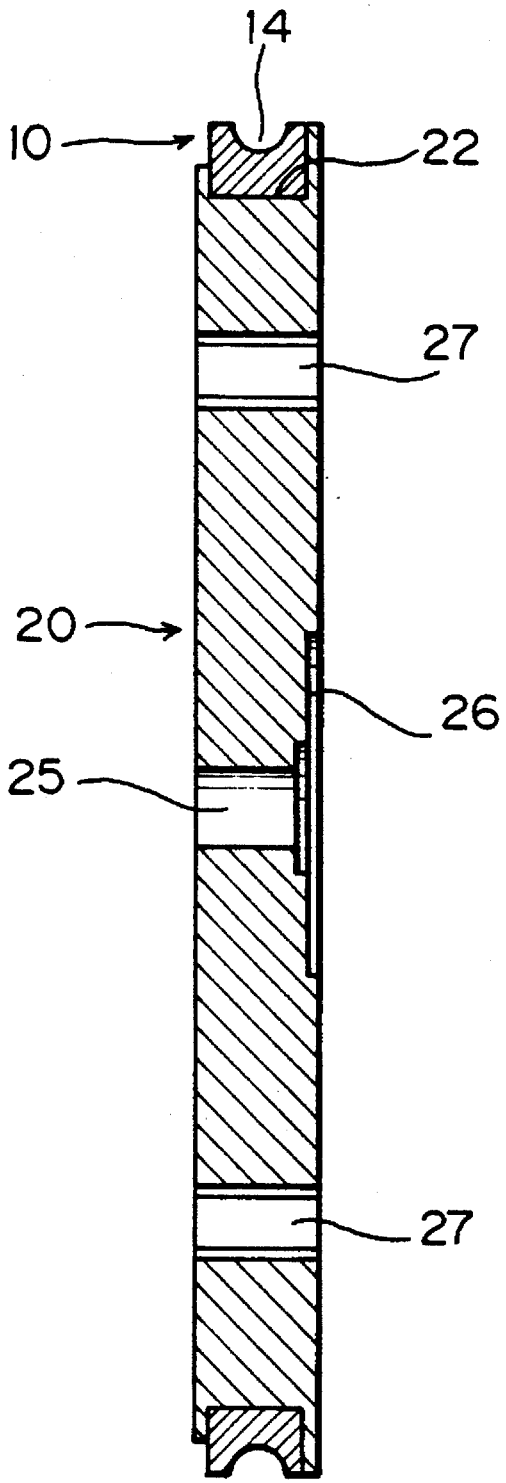
FIG. 8 is a cross-sectional view taken along line A—A of FIG. 7.

FIGS. 7–11 illustrate more concrete examples of bending dies which can be used in the method of the present invention. As shown in FIGS. 7 and 8, the bending die comprises a C-shaped ring die 10 and a disk-shaped holder 20. The ring die 10 is made of a material having good elasticity, such as S45C steel, and it is formed into a perfectly circular C-shape. A radially inward projection 11 is formed on one end of the ring die 10. The other end of the ring die 10 has a portion of reduced thickness 12 wherein a portion of the outer periphery of the ring die 10 is removed, and a screw hole 13 through which a securing screw 30 passes is formed in the reduced thickness portion 12. A die groove 14 extends in the circumferential direction along the outer surface of the ring die 10 except in the reduced thickness portion 12. The cross-sectional shape of the die groove 14 is a semicircle corresponding to the outer shape of the workpiece to be bent, which in this case is a tube. The workpiece may be a rod or bar.

Figure 9:
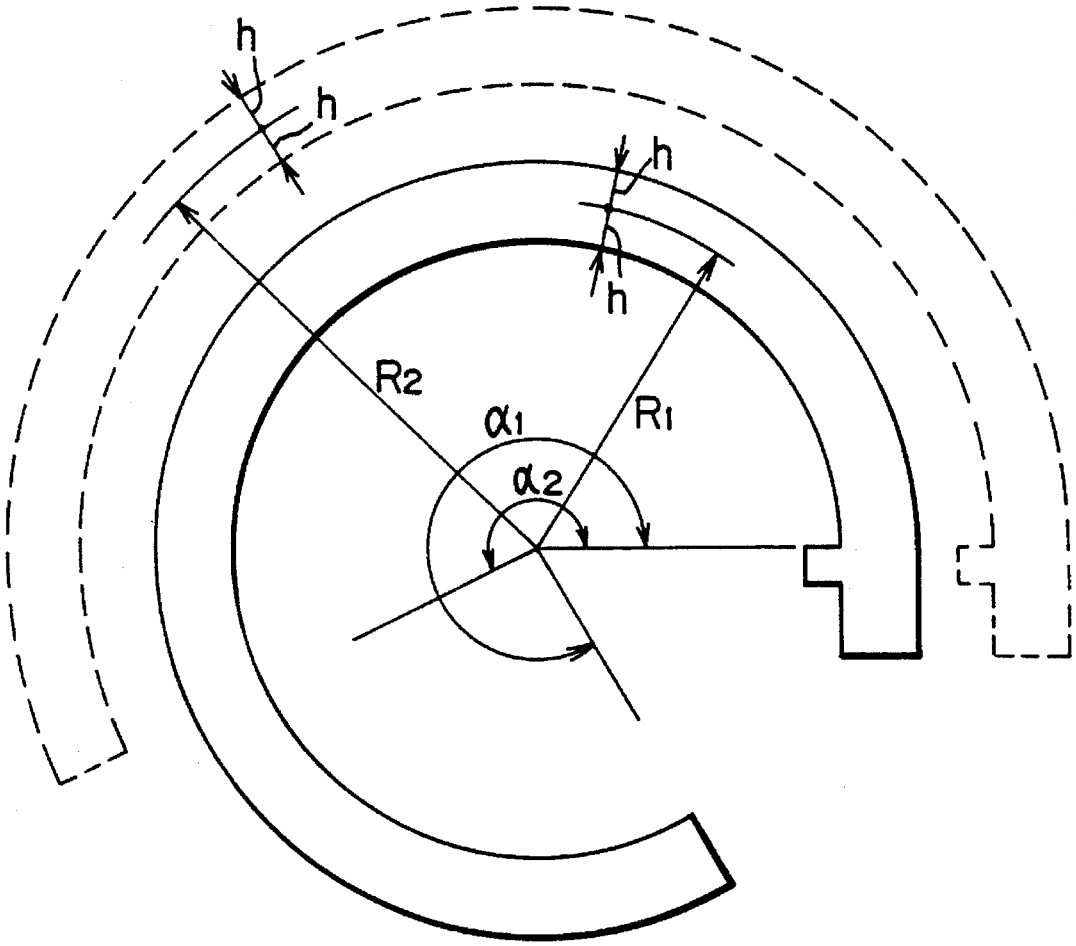
FIG. 9 is a schematic plan view showing the deformation of a ring die.

The ring die 10 is made of a metallic material such as steel having good elasticity, so as shown in FIG. 9, the average radius R can be expanded within the elastic limit. Furthermore, within the elastic limit and within the limits imposed by the gap between the ends of the ring die 10, the average radius R can be decreased.

When the average radius R is increased, the central angle $\alpha$ of the portion of the ring die usable for bending decreases from $\alpha_1$ prior to deformation to $\alpha_2$ after deformation. If the average radius prior to deformation is $R_1$, the average radius after deformation is $R_2$, and the thickness of the ring die 10 is **2*h***, then the strain E is given by $$\epsilon = h(1/R_1 - 1/R_2)$$

The change in the cross-sectional shape of the die groove 14 due to this strain is negligibly small.

The holder 20 for releasably holding the ring die is a disk slightly thicker than the ring die 10. A cutout 21 is formed in a portion of the circumference of the outer periphery of the holder 20. Except for in the cutout 21, a groove 22 into which the ring die 10 is fit is formed in the peripheral surface of the ring die 10.

The bottom surface of the groove 22 is a perfect circle which is concentric with respect to the center of the holder 20, and it is continuous with the peripheral surface of the cutout 21. The outer diameter of the bottom surface can be smaller, larger, or the same as the inner diameter of the ring die 10 as manufactured. More particularly, it is selected in accordance with whether the diameter of the ring die undergoes no change, expands, or contracts within the limit of deformation such that the inner peripheral surface of the ring die 10 will be in intimate contact with the bottom surface of the groove 22.

A notch 23 into which is fit the projection of the ring die 10 is formed in the outer peripheral surface of one end of the cutout 21. A screw hole 24 corresponding to screw hole 13 is formed in the outer peripheral surface of the ring die 10 at the other end of the cutout 21. The circumferential length of the bottom surface of the groove 22 from the notch 23 to the screw hole 24 matches the length of the ring die 10 measured along its inner periphery from the projection 11 to the screw hole 13. The central angle between the projection 11 and the screw hole 13 is selected to give the ring die 10 a suitable central angle α during bending.

After the ring die 10 is fit into the groove 22 and the projection 11 is fit into the notch 23, the screw 30 is passed through screw hole 13 and screwed into screw hole 24, whereby the inner periphery of the ring die 10 is made to intimately contact the bottom surface of the groove 22 along its entire length in the circumferential direction and the ring die 10 is given the necessary radius and central angle α.

In FIG. 8, 25 is a through hole formed at the center of the holder 20 for use in installation of the holder 20, 26 is a keyway for use in setting the position of the holder 20 in the circumferential direction, and 27 is a plurality of screw holes provided around through hole 25 for use in installing the holder 20.

Figure 2A:
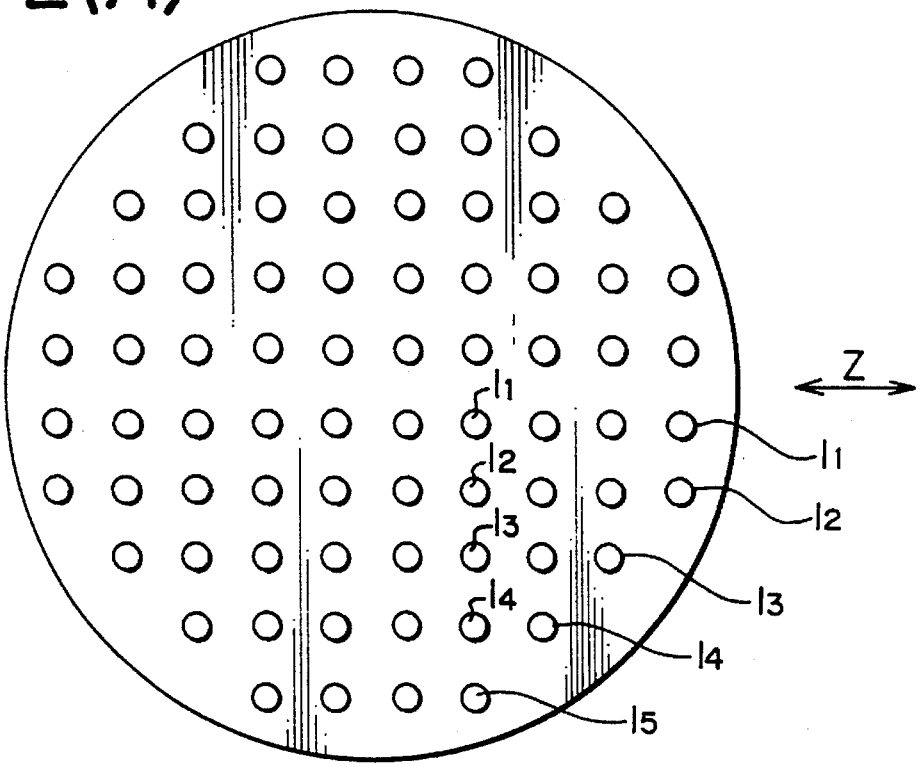
FIGS. 2A and 2B are plan views schematically illustrating different arrangements of heat transfer tubes.
Figure 2B:
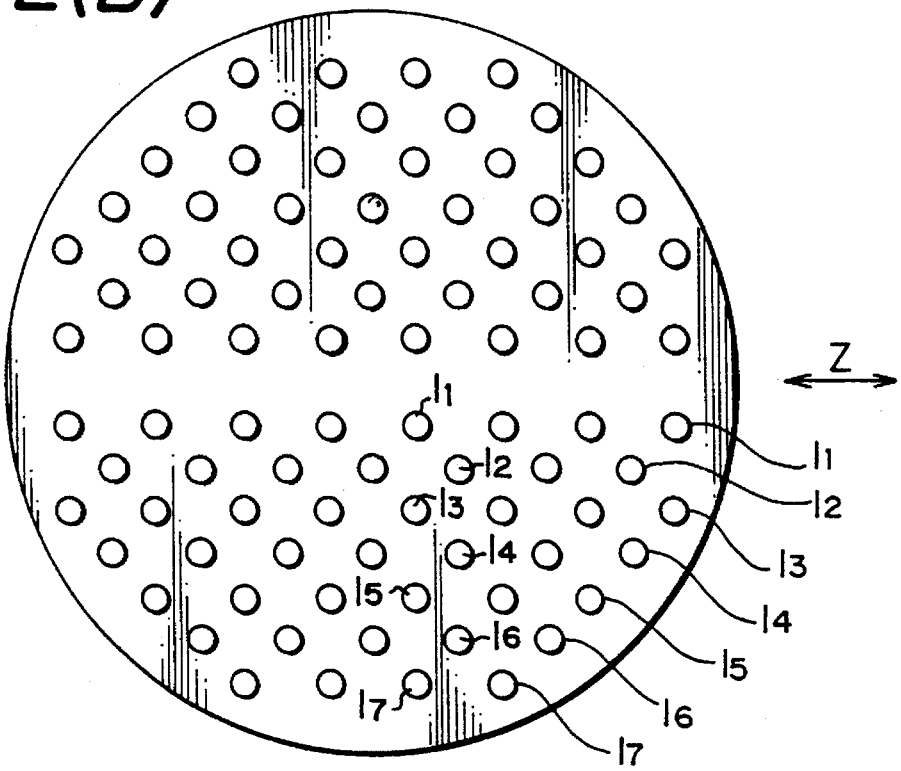
Figure 3A:
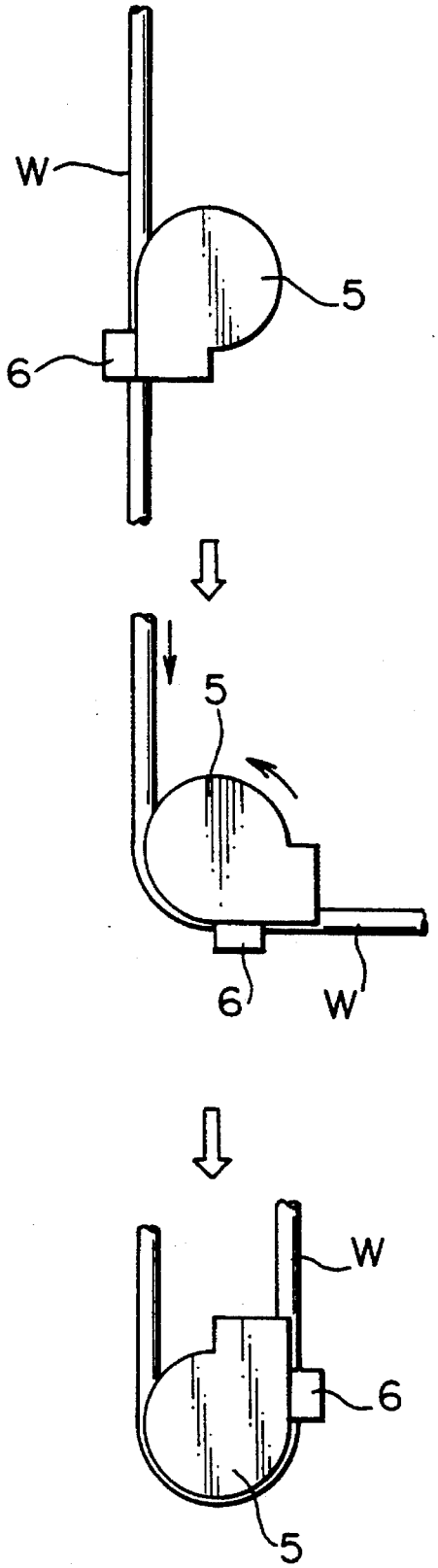
FIGS. 3A and 3B are plan views schematically illustrating two different bending methods.
Figure 3B:
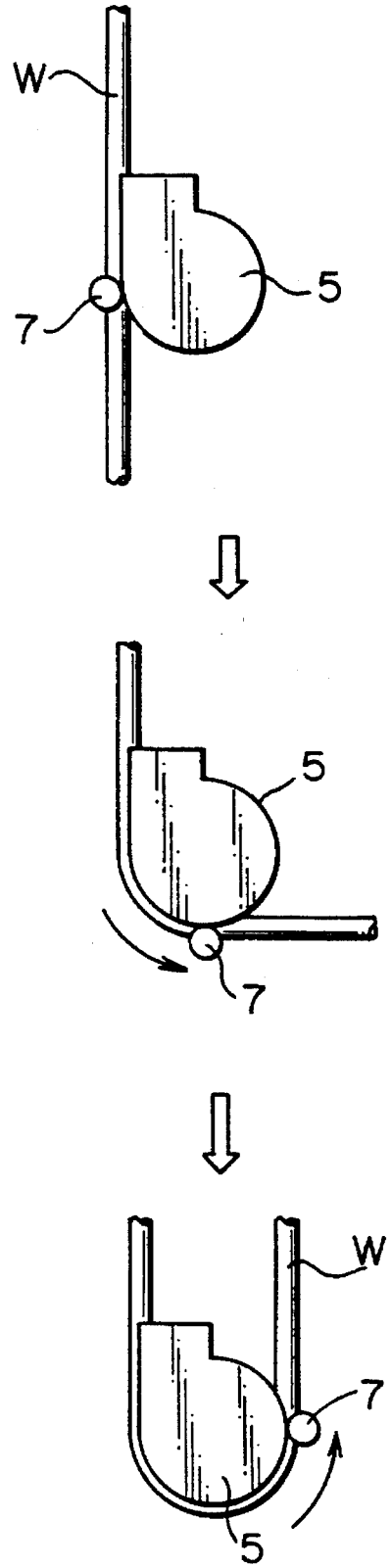
Figure 4:
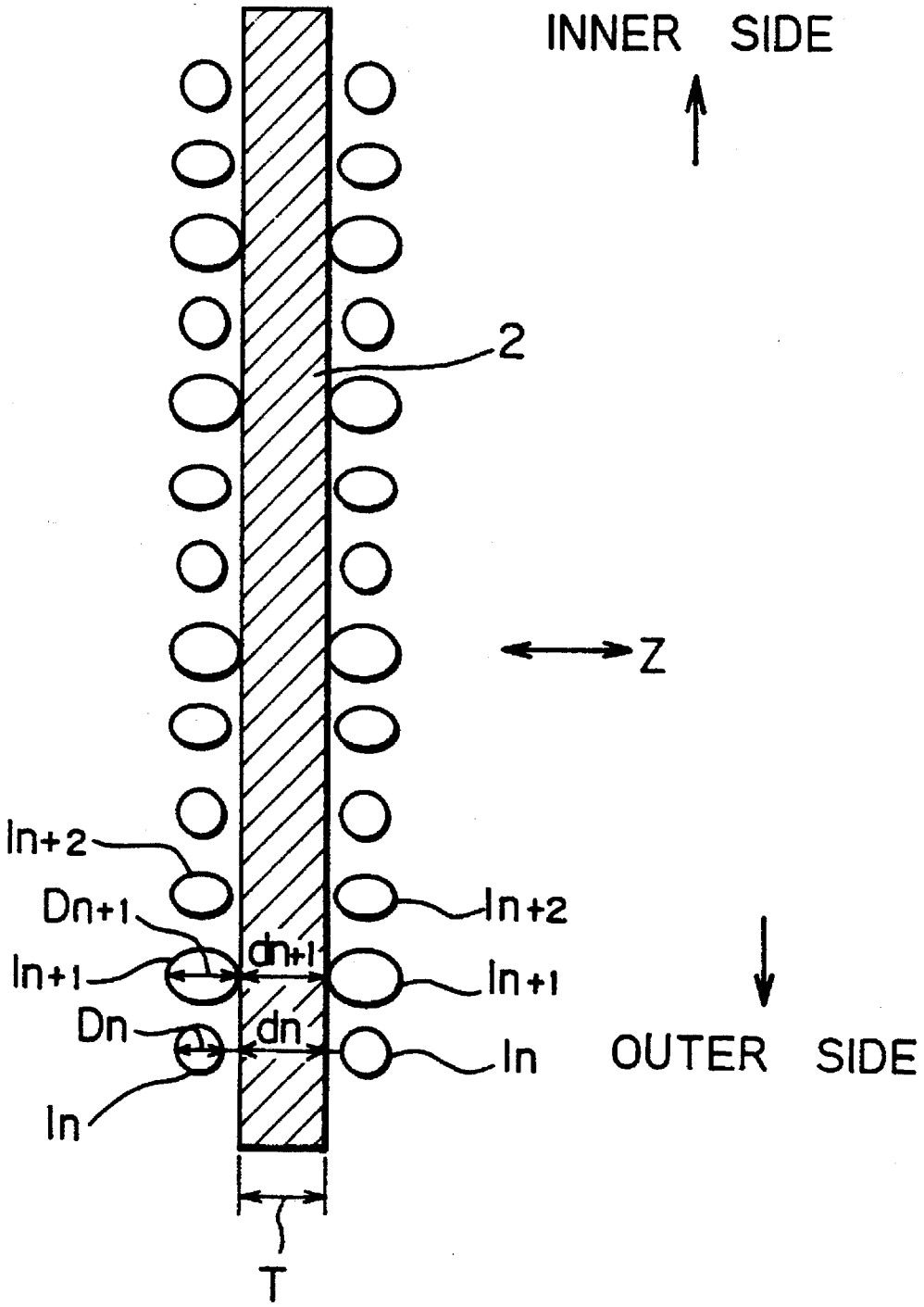
FIG. 4 is a schematic cross-sectional view of heat transfer tubes in a conventional heat exchanger.

Like the bending die 5 of FIGS. 3A and 3B, this bending die is used with a rotary draw bending apparatus or a compression bending apparatus. It is possible to increase to decrease the diameter of the ring die 10 of the bending die, so the radius to be used is determined by the outer diameter of the holder 20. By combining the die 10 with a holder of a different diameter, bending to a different bending radius is possible.

In this bending die, the means for securing the end of the ring die 10 can be simplified. Namely, when the ring die 10 does not undergo deformation, even if the screw 30 for holding one end of the ring die 10 is omitted, the inner periphery of the ring die 10 will still intimately contact the outer periphery of the holder 20. When the ring die 10 is made to increase or decrease in diameter, if the screw 30 for securing one end is omitted, as shown in FIG. 10, the ring die 10 will float on the outer periphery of the holder 20. However, when bending is carried out, due to the load which is applied, the ring die 10 will intimately contact the outer peripheral surface of the holder 20. Therefore, if the workpiece is one which is difficult to crush such as a rod or a thick-walled tube, the means for securing one end can be omitted. However, an extra load will be applied to the workpiece, so when the workpiece is a material which is easily crushed, such as a thin-walled tube, it is desirable to provide intimate contact between the ring die 10 and the outer surface of the holder 20 prior to bending by securing both ends of the ring die 10.

FIGS. 11A–11C are plan views showing other possible shapes of the holder 20 for releasably holding the ring die. The ring die 10 is flexible, so it can be deformed along the outer surface of a holder 20 which is not a perfect circle. Therefore, a workpiece can be bent into a non-circular shape.

Figure 12:
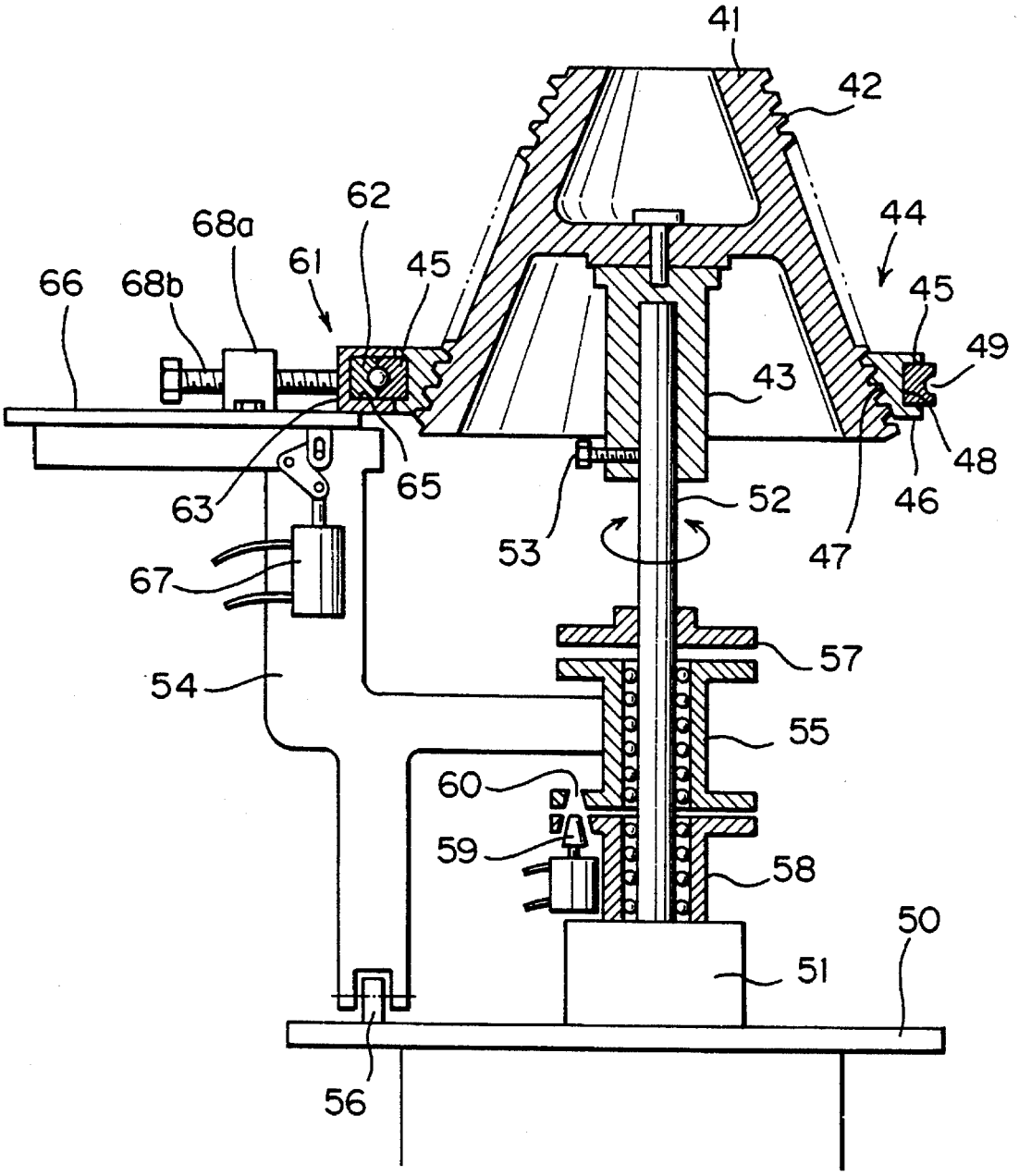
FIG. 12 is a vertical cross-sectional view of an embodiment of a bending apparatus according to the present invention.
Figure 13:
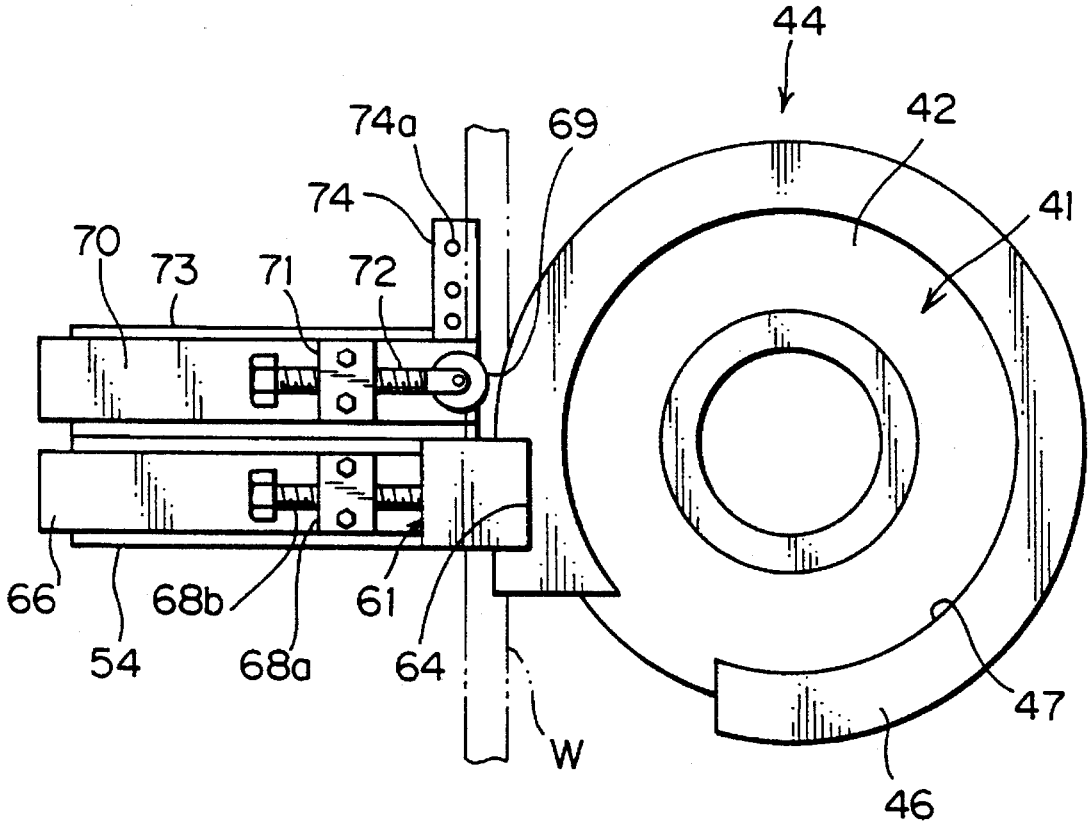
FIG. 13 is a plan view of the bending apparatus of FIG. 12.

FIGS. 12–15 show another bending apparatus for use in carrying out the bending method of the present invention. As shown in FIGS. 12 and 13, this apparatus has a frustoconical holder 41 with a vertically extending axis. A male thread 42 is formed on the tapered outer surface of the holder 41 along the entire axial length. A sleeve 43 having a spline groove along its inner periphery is vertically disposed at the center of the holder 41. Examples of the dimensions of the holder 41 are a height of 300 mm, a minimum outer diameter at the upper end of 1880 mm, and a maximum outer diameter at the lower end of 2100 mm.

A ring die 44 is fit on the outside of the holder 41. Like the ring die 10 of the previous embodiment, this ring die 44 is a C-shaped split ring made of a material having good elasticity, such as S45C steel. It comprises a die body 45 and a die base 46.

The die body 45 has a die groove 49 which is formed in its entire outer periphery and has a cross-sectional shape corresponding to the outer shape of a workpiece to be bent, such as a tube. It fits inside a groove 48 formed in the outer periphery of the die base 46. A female thread 47 for engaging with the male thread 42 of the holder 41 is formed on the inner periphery of the die base 46. Accordingly, if the holder 41 and the ring die 44 are rotated relative to one another, the ring die 44 will move in the axial direction of the holder 41 so that its radius can be increased or decreased.

Next, a support mechanism, a rotational drive mechanism, and a clamping mechanism of the holder 41 will be described.

A hydraulic motor 51 is disposed atop a base 50. The motor 51 rotates a drive shaft 52 which extends vertically from the motor 51. The upper end of the drive shaft 52 acts as a spline and is inserted into the sleeve 43. The sleeve 43 is secured to the drive shaft 52 at a desired height by a set screw 53 so that the height of the holder 41 can be adjusted.

A rotatable base 54 is disposed atop the base 50. The rotatable base 54 extends outwards from the drive shaft 52 and is connected to a bearing 55 which surrounds the drive shaft 52. A roller 56 is mounted on the lower portion of the rotatable base 54 so that the base 54 can rotate about the drive shaft 52. An electromagnetic clutch 57 is disposed above the bearing 55. When the clutch 57 is engaged, the bearing 55 is connected to the drive shaft 52, so the rotatable base 54 rotates with the drive shaft 52. When the clutch 57 is disengaged, no drive force is transmitted to the rotatable base 54, and the base 54 remains stationary as the drive shaft 52 rotates.

A non-rotating bearing 58 which serves as a support for the drive shaft 52 and bearing 58 is disposed below bearing 55. A pin 59 which is driven by a cylinder is installed on bearing 58. When the rotatable base 54 is in its initial position, the pin 59 is inserted into a pin hole 60 in bearing 55 and secures the rotatable base 54 in its initial position.

A head 61 for grasping a workpiece is mounted atop a support surface of the rotatable base 54. The head 61 is a clamp used in a rotary draw bending apparatus (corresponding to clamp 6 of FIG. 3A). It is disposed on the outer periphery of the holder 41 and comprises a clamp body 62 and a clamp holder 63. The clamp body 62 opposes a portion of the circumference of the die body 45 of the ring die 44. A groove 65 having a semicircular cross-sectional shape corresponding to the outer shape of the workpiece (such as a tube) is formed in the surface opposing the die body 45. The clamp holder 63 is C-shaped and it holds the clamp body 62 between its upper and lower portions. These upper and lower portions fit into a pair of upper and lower notches 64 formed in the die base 46, so that the ring die 44 is secured in both the circumferential and the axial directions. See FIG. 13.

The head 61 is mounted on a sliding base 66 which can freely move in the radial direction of the holder 41 on the top surface of the rotatable base 54. The sliding base 66 is driven by a cylinder 67 installed on the rotatable base 54 between a retracted position in which it is separated from the ring die 44 and an operating position in which it is pressed against the ring die 44 and clamps the workpiece. A feed screw 68*b* passes through a nut 68*a* secured to the sliding base 66. By rotation of the feed screw 68*b*, the head 61 is moved in the radial direction of the holder 41 atop the sliding base 66 and its operating position can be adjusted.

A guide roller 69 is provided on the outer periphery of the holder 41. The guide roller 69 is a so-called caliber roller having a semicircular groove corresponding to the external shape of the workpiece (such as a tube, rod, and bar) formed around its entire periphery. Like the head 61, it opposes the ring die 44. Its position in the radial direction of the holder 41 can be adjusted by a sliding base 70, a nut 71, and a feed screw 72 so that it clamps the workpiece. It is supported on a base 73 which is supported independently of the rotatable base 54 in a location parallel to the rotatable base 54 when the base 54 is in its initial position.

The guide roller 69 is mounted on a support base 74 disposed at the end of the feed screw 72. It can be secured at a desired position along a line extending at right angles to the radial direction of the holder 41, i.e., extending in the tangential direction of the holder 41. Therefore, the position where the guide roller 69 clamps the workpiece can be adjusted in the longitudinal direction of the workpiece. Pin holes 74*a* for securing the guide roller 69 at a desired position are formed in the base 74.

Operation of this embodiment is as follows. In order to set the bending radius, before inserting a workpiece W into the apparatus, the rotatable base 54 is fixed in an initial position by securing pin 59. The ring die 44 is secured in the circumferential and axial directions by the head 61. The set screw 53 is loosened so that the holder 41 is free to move in the axial direction. In addition, the clutch 57 is disengaged so that the rotatable base 54 is detached from the drive shaft 52.

Figure 14:
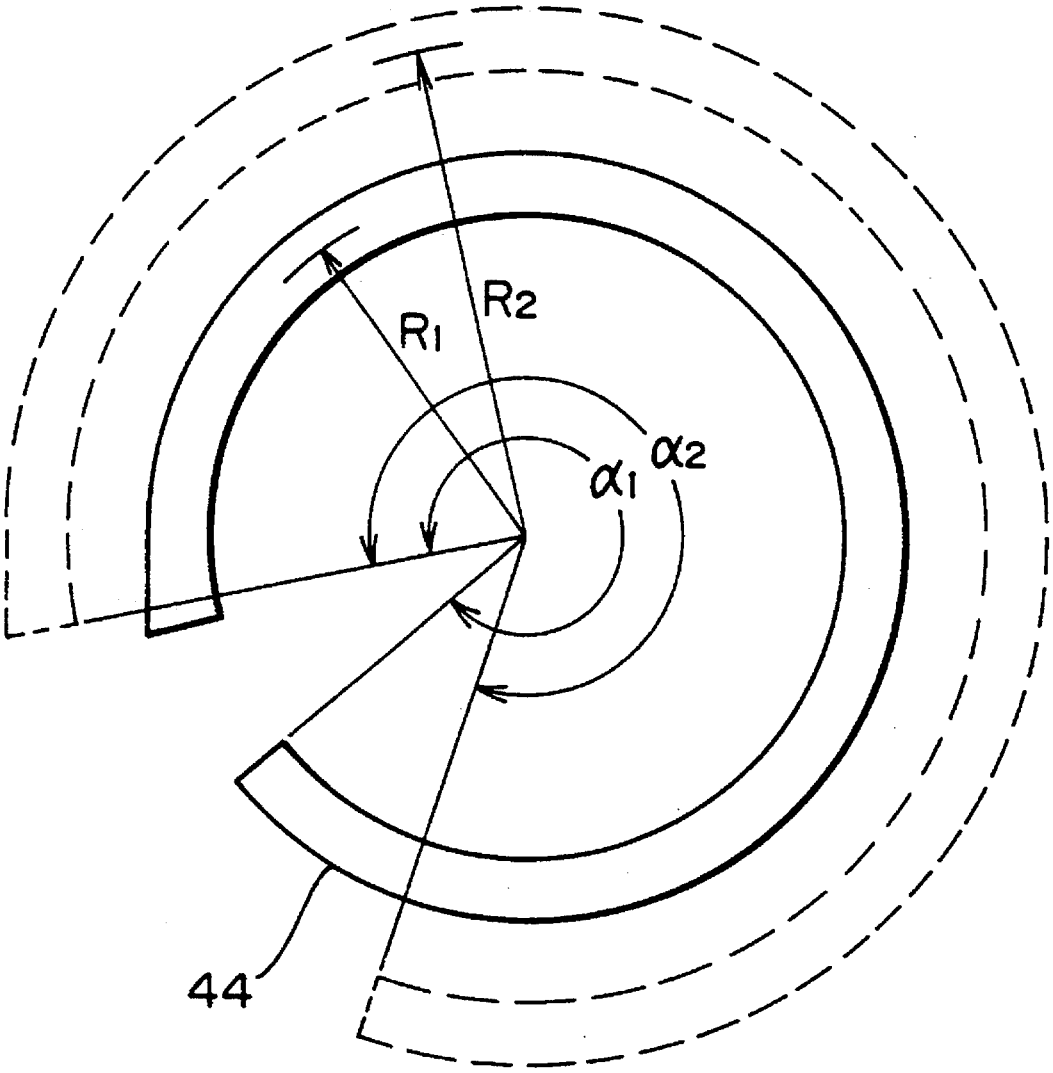
FIG. 14 is a schematic plan view showing the deformation of a ring die.

In this state, the feed screw 68*b* is operated, and the ring die 44 is pressed against the periphery of the holder 41 with a suitable pressure. The hydraulic motor 51 is then operated to rotated the drive shaft 52. As a result, the holder 41 rotates about its axis. At this time, the holder 41 is free to move in the axial direction, while the ring die 44 is clamped by the head 61 in the circumferential and axial directions. Therefore, due to the rotation of the holder 41, the holder 41 is moved in the axial direction, so the position where the ring die 44 is hold in the axial and radial directions of the holder 41 can be varied. As a result, as shown in FIG. 14, the average radius R of the ring die 44 can be varied.

The ring die 44 has a minimum radius $R_1$ at the upper end of the holder 41 and a maximum radius $R_2$ at the lower end. In order that the ring die 44 can be held against the holder 41 even at the upper end of the holder 41, the ring die 44 is manufactured with a radius slightly smaller than the minimum radius $R_1$ at the upper end of the holder 41. Furthermore, the material, dimensions, and structure of the ring die 44 are selected such that the elastic limit will not be exceeded at the lower end of the holder 41. Because the ring die 44 is divided into the die body 45 and the die base 46, the thickness of each part can be decreased, and the amount of elastic deformation can be increased.

The central angle $\alpha$ by which the ring die 44 extends around the holder 41 is a maximum $\alpha_1$ at the upper end of the holder 41 and a minimum $\alpha_2$ at the lower end. When forming a U-bend, the minimum value of $\alpha$ is $(180+\gamma)$ degrees, wherein $\gamma$ is the springback angle, which depends on factors including the dimensions, the materials, and the bending radius. The circumferential length of the ring die 44 is selected so as to satisfy this condition. For example, when the holder 41 has a height of 300 mm, a minimum outer diameter of 1880 mm, and a maximum outer diameter of 2100 mm, then if the circumferential length of the ring die 44 along its inner periphery is 5500 mm, an angle $\alpha_1$ of 335 degrees at the upper end of the holder 41 and an angle $\alpha_2$ of 300 degrees at the lower end can be maintained.

Figure 15:
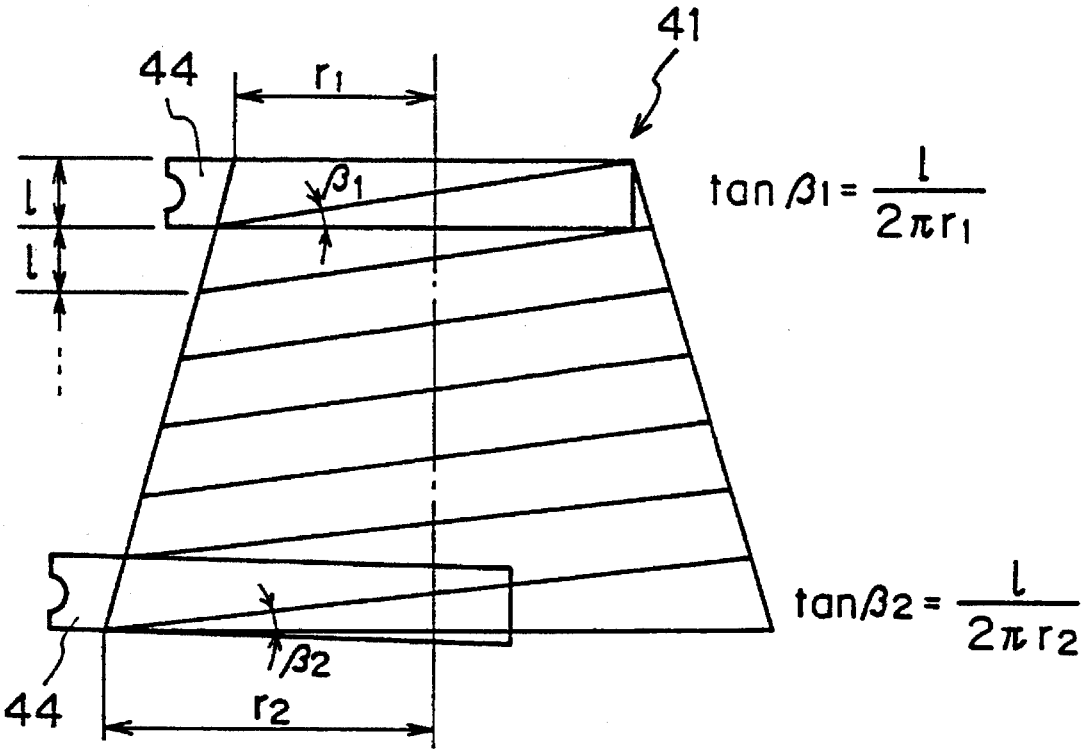
FIG. 15 is a schematic side view for explaining the flatness of a ring die.

When the ring die 44 is moved in the axial direction of the holder 41, as shown in FIG. 15, the lead angle $\beta_1$ at the upper end of the holder 41 and the lead angle $\beta_2$ at the lower end are different, resulting in slanting of the ring die 44. However, when the holder 41 has a height of 300 mm, a minimum outer diameter of 1880 mm, and a maximum outer diameter of 2100 mm and the length of the lead 1 is 5 mm, then the difference between high and low in the circumferential direction due to slanting is only about 0.2 mm and can be ignored.

When the radius of the ring die 44 is adjusted in the above manner to a target value, the set screw 53 is tightened to secure the holder 41 at the appropriate height, and bending can then be performed.

In order to carry out bending, the securing pin 59 is retracted so that the rotatable base 54 is free to rotate. Cylinder 67 is then operated and head 61 is moved to its retracted position. A workpiece W is positioned between the head 61 and the ring die 44, and the head 61 is advanced to its operating position in which it engages the ring die 44 so as to clamp the workpiece W. Furthermore, the workpiece W is grasped by the guide roller 69. The clutch 57 is then engaged and the hydraulic motor 51 is driven.

As a result, the holder 41 is rotated about its axis, and the head 61 and the rotatable base 44 are rotated about the axis of the holder 41 together with the holder 41. The workpiece W is therefore pulled by the head 61 and is wound around the die groove 49 in the ring die 44. Namely, rotary draw bending of the workpiece W takes place.

When bending is completed, the hydraulic motor 51 is stopped, the head 61 is withdrawn to its retracted position, the guide roller 69 is moved away from the workpiece W, and the workpiece W is removed. After removal of the workpiece W, the clutch 57 is left engaged, and the drive shaft 52 is rotated in the reverse direction by the hydraulic motor 51 to return the holder 41 and the rotatable base 54 to their initial positions, thereby completing one cycle of bending.

The above-described apparatus is a rotary draw bending apparatus. However, if the head 61 is replaced by a roller, the rotatable base 54 supporting the roller is connected at all times to a rotational drive mechanism, and the holder is connected at suitable times to the rotational drive mechanism, then the apparatus can be converted to a compression bending apparatus.

Instead of having the holder 41 be movable in the axial direction, the head 61 can be made movable in the axial direction of the holder. Furthermore, instead of having the head 61 movable in the radial direction of the holder 41, the holder 41 can be made movable in its radial direction.

The present invention will be further described by the following examples.

EXAMPLE 1

The first form of the bending method of the present invention was used to form U-bend tubes for use as steam generator tubes for a pressurized water reactor.

The tubes to be bent were small size and long tubes made of Alloy 690 (a trademark of Inco Corporation) with nominal dimensions of 17.40 mm in outer diameter and 1.02 mm in wall thickness. Eighty types of tubes having bending radii varying from 520 mm to 1453 mm were formed. These 80 types were divided into 5 groups A–E as shown in Table 1. Each tube was bent using a disk-type bending die like that shown in FIGS. 7 and 8.

The tubes in group A had 8 different bending radii of from 520 mm to 602 mm. Bending was carried out using a bending die with a basic radius of 452.5 mm and a groove diameter of 17.48 mm. Group B comprised tubes having 9 different bending radii varying from 614 mm to 709 mm, and bending was performed using a bending die with a basic radius of 527.5 mm and a groove diameter of 17.45 mm. Group C comprised tubes having 14 different bending radii varying from 720 mm to 874 mm, and bending was performed using a bending die with a basic radius of 627.5 mm and a groove diameter of 17.49 mm. Group D comprised tubes having 19 different bending radii varying from 886 mm to 1110 mm, and bending was performed using a bending die with a basic radius of 742.5 mm and a groove diameter of 17.42 mm. Group E comprised tubes having 28 different bending radii varying from 1122 mm to 1453 mm, and bending was performed using a bending die with a basic radius of 920.0 mm and a groove diameter of 17.50 mm.

The variation in the outer diameter of the U-bend portions of the tubes measured in the Z direction for all 80 types of tubes is shown in Table 1. The number of tubes of each bending radius was 10 pieces.

As only 5 types of ring dies were used to bend all the tubes of 80 different bending radii, the groove diameter of each die could be carefully maintained.

In group E, the upper limit on the groove diameter was made 17.50 mm, and in groups A and C, the upper limits were set to 17.48 mm and 17.49 mm, respectively, in light of the maximum increase in tube outer diameter within each group. The groove diameters for the 5 types of ring die were in the range of 17.42 mm to 17.50 mm, so the maximum value of the tube outer diameter in groups A, C, and E could be made 17.50 mm, and the variation in the tube outer diameter among all the tubes could be limited to 0.10 mm. The reason that the variation was largest in group E was that a ring die having the upper limit of groove diameter is used for tubes having a large bending radius and a small tendency to become elliptical, so there were many tubes for which the die grooves did not cause enough to control the tubes to become elliptical.

Using these U-bend tubes, an array of heat transfer tubes can be formed in which the separation between bends in the hemispherical portion is uniform from the inside to the outside. The thickness of an antivibration bar inserted in the gaps between the bends is determined by the maximum value of the outer diameter of the tubes, since the gap is smallest in the portion where the tube outer diameters are largest.

All 80 types of tubes having a maximum outer diameter in the bends ranging from 17.40 mm to 17.50 mm can be restrained by an antivibration bar having a uniform thickness over its length determined by the maximum outer diameter of 17.50 mm.

EXAMPLE 2

In this example, the tubes to be bent, the bending radii, the number of groups, the number of different bending radii in each group, and the basic radii of the ring die were the same as in Example 1. The groove diameters of the ring dies were 17.42 mm for group A, 17.425 mm for group B, 17.43 mm for group C, 17.44 mm for group D, and 17.44 mm for group E. The results are shown in Table 2.

The lower limit for the groove diameter for group A was made the preferred value of 17.42 mm, and the groove diameter for the other groups was increased in a stepwise manner as the bending radius increased, taking into account the amount of increase in the tube outer diameter. Therefore, the maximum value of the tube outer diameter for all the groups could be a uniform value of 17.44 mm. The variation of the tube outer diameter for all the tubes was restricted to 0.04 mm.

EXAMPLE 3

In this example the groove diameter of the ring dies was 17.42 mm for each group. The conditions were otherwise the same as for Example 1. The results are shown in Table 3.

The groove diameter for all 5 types of ring die was set to the preferred lower limit of 17.42 mm, so the maximum value of the outer diameter of the tubes varied from 17.42 mm to 17.44 mm for each group and decreased from groups having a small bending radius towards groups having large bending radius in accordance with the increase in the tube outer diameter and could be held to a low value. The variation of the tube outer diameter among all the tubes could be limited to 0.04 mm. With these tubes, an antivibration bar 2 like the one shown in FIG. 5B having a thickness which increases in a stepwise manner from the inside to the out side can be used.

EXAMPLE 4

Except for the groove diameters of the ring dies, the conditions were the same as for Example 1. The groove diameters were 17.48 mm for group A, 17.46 mm for group B, 17.44 mm for group C, 17.43 mm for group D, and 17.42 mm for group E. The results are shown in Table 4.

The groove diameters of the 5 types of ring dies decreased in a stepwise manner from groups having a small bending radius to groups having a large bending radius. The groove diameter for group E was the preferred lower limit of 17.42 mm, so the maximum value of the tube outer diameters for all the groups could be maintained in the range from 17.42 to 17.50, the maximum value decreasing as the bending radius increased. The variation in the outer diameter for all the tubes could be limited to 0.10 mm. An antivibration bar 2 like that shown in FIG. 5B can be used with these tubes.

EXAMPLE 5

The second form of the bending method of the present invention was used to bend 5 groups of tubes of 80 different types. The groove diameters of the ring dies were 17.55 mm for group A, 17.50 mm for group B, 17.48 mm for group C, 17.46 mm for group D, and 17.45 mm for group E. The results are shown in Table 5.

Because the groove diameter of the ring dies decreased in a stepwise manner from groups having a small bending radius to groups having a large bending radius, the maximum tube outer diameter of each group decreased in a stepwise manner from group to group as the bending radius increased, so an antivibration bar having a thickness which decreases from its outside towards its inside can be used. In group E, which included tubes for which $R/D_0 \geqq 80$, the groove diameter was selected to be within the range of $D_0$ to $D_0+0.1$ mm according to the present invention, so the variation of the tube outer diameter was limited to at most 0.05 mm. (The groove diameters for the other groups also fell into this range). As a result, the bends of the tubes within each group can be reliably supported by the corresponding portion of an antivibration bar.

Having the groove diameter of a plurality of ring dies decrease in a stepwise manner from group to group as the bending radius increases and having the groove diameter be from $D_0$ to $D_0$+0.1 mm for at least the groups for which $R/D_0 \geqq 80$ gives regularity to the maximum tube outer diameter for each group. Furthermore, as the tendency to become elliptical decreases as the bending radius increases, it allows the die grooves to exhibit an elliptical clamping effect, so the variation of the tube outer diameter within a group can be decreased, the regularity is maintained, and the groove diameter can be the same for some of the plurality of the ring dies.

However, overall, it is necessary to vary the groove diameter in a stepwise manner from group to group as the bending radius increases. If this is not done, the maximum value of the tube outer diameter becomes large for the intermediate groups and for the outside groups for which the bending radius is large. In this case, an antivibration bar having a thick midportion or a thick inner end becomes necessary, and such an antivibration bar can not be inserted between bends from the outside towards the inside.

COMPARATIVE EXAMPLE

Except for the groove diameter of the ring dies, the conditions were the same as for Example 1. The groove diameter of the ring dies was 17.51 mm for each group. The results are shown in Table 6.

The groove diameters were all greater than $D_0$+0.1 mm, so the variation of the outer diameters of the tubes could not be limited to 0.10 mm. Furthermore, in group E in which $R/D_0 \geqq 80$, the groove diameter was greater than $D_0$+ 0.1 mm, so the variation of the tube outer diameter in group E could not be limited to 0.10 mm.

As can be seen from the above description, in a heat exchanger comprising tubes bent by the method of the present invention, the variation of the outer diameter of U-bend tubes in the same bending plane is small, so the tubes can be more reliably supported by an antivibration bar inserted between bending planes.

Furthermore, as the method of the present invention enables a large number of different tubes to be bent using a small number of bending dies, equipment costs can be greatly decreased. Furthermore, even when the tubes have a large number of bending radii, the outer diameters of the tubes can be carefully maintained. Accordingly, a large number of U-bend tubes suitable for manufacturing heat transfer tubes for a heat exchanger can be economically manufactured according to the present invention.

TABLE 1

| Group | Bending Radius No. | Bending Radius (mm) | Groove Diameter (mm) | Range of Outer Diameter (mm) | Variation in Outer Diameter (mm) Within Group | Variation in Outer Diameter (mm) Over-all |
|---|---|---|---|---|---|---|
| A | 1~8 | 520~602 | 17.48 | 17. 46~17.50 | 0.04 | 0.10 |
| B | 9~17 | 614~709 | 17.45 | 17.44~17.47 | 0.03 | |
| C | 18~31 | 720~874 | 17.49 | 17.45~17.50 | 0.05 | |
| D | 32~51 | 886~1110 | 17.42 | 17.40~17.42 | 0.02 | |
| E | 52~80 | 1122~1453 | 17.50 | 17.40~17.50 | 0.10 | |

TABLE 2

| Group | Bending Radius No. | Bending Radius (mm) | Groove Diameter (mm) | Range of Outer Diameter (mm) | Variation in Outer Diameter (mm) Within Group | Variation in Outer Diameter (mm) Over-all |
|---|---|---|---|---|---|---|
| A | 1~8 | 520~602 | 17.42 | 17.42~17.44 | 0.02 | 0.04 |
| B | 9~17 | 614~709 | 17.425 | 17.42~17.44 | 0.02 | |
| C | 18~31 | 720~874 | 17.43 | 17.42~17.44 | 0.02 | |
| D | 32~51 | 886~1110 | 17.44 | 17.41~17.44 | 0.03 | |
| E | 52~80 | 1122~1453 | 17.44 | 17.40~17.44 | 0.04 | |

TABLE 3

| Group | Bending Radius No. | Bending Radius (mm) | Groove Diameter (mm) | Range of Outer Diameter (mm) | Variation in Outer Diameter (mm) Within Group | Variation in Outer Diameter (mm) Over-all |
|---|---|---|---|---|---|---|
| A | 1~8 | 520~602 | 17.42 | 17.42~17.44 | 0.02 | 0.04 |
| B | 9~17 | 614~709 | 17.42 | 17.42~17.44 | 0.02 | |
| C | 18~31 | 720~874 | 17.42 | 17.41~17.43 | 0.02 | |
| D | 32~51 | 886~1110 | 17.42 | 17.40~17.42 | 0.02 | |
| E | 52~80 | 1122~1453 | 17.42 | 17.40~17.42 | 0.02 | |

TABLE 4

| Group | Bending Radius No. | Bending Radius (mm) | Groove Diameter (mm) | Range of Outer Diameter (mm) | Variation in Outer Diameter (mm) Within Group | Variation in Outer Diameter (mm) Over-all |
|---|---|---|---|---|---|---|
| A | 1~8 | 520~602 | 17.48 | 17.46~17.50 | 0.04 | 0.10 |
| B | 9~17 | 614~709 | 17.46 | 17.45~17.48 | 0.03 | |
| C | 18~31 | 720~874 | 17.44 | 17.43~17.45 | 0.02 | |
| D | 32~51 | 886~1110 | 17.43 | 17.41~17.43 | 0.02 | |
| E | 52~80 | 1122~1453 | 17.42 | 17.40~17.42 | 0.02 | |

TABLE 5

| Group | Bending Radius No. | Bending Radius (mm) | Groove Diameter (mm) | Range of Outer Diameter (mm) | Variation in Outer Diameter (mm) Within Group |
|---|---|---|---|---|---|
| A | 1~8 | 520~602 | 17.55 | 17.53~17.57 | 0.04 |
| B | 9~17 | 614~709 | 17.50 | 17.48~17.52 | 0.04 |
| C | 18~31 | 720~874 | 17.48 | 17.45~17.50 | 0.05 |
| D | 32~51 | 886~1110 | 17.46 | 17.43~17.47 | 0.04 |
| E | 52~80 | 1122~1453 | 17.45 | 17.40~17.45 | 0.05 |

TABLE 6

| Group | Bending Radius No. | Bending Radius (mm) | Groove Diameter (mm) | Range of Outer Diameter (mm) | Variation in Outer Diameter (mm) Within Group | Variation in Outer Diameter (mm) Over-all |
|---|---|---|---|---|---|---|
| A | 1~8 | 520~602 | 17.51 | 17.49~17.53 | 0.04 | 0.13 |
| B | 9~17 | 614~709 | 17.51 | 17.48~17.53 | 0.05 | |
| C | 18~31 | 720~874 | 17.51 | 17.45~17.52 | 0.07 | |
| D | 32~51 | 886~1110 | 17.51 | 17.41~17.51 | 0.10 | |
| E | 52~80 | 1122~1453 | 17.51 | 17.40~17.51 | 0.11 | |

What is claimed is:

1. A method of forming U-shaped tubes comprising:

deforming an elastic ring die to a plurality of different bending radii, the ring die having a portion missing from its circumference enabling elastic radial deformation and a circumferentially extending bending groove having a cross section with a diameter and a shape corresponding to an external shape of a tube to be bent; and bending a different tube around the ring die at each bending radius to form a U-shaped portion in each tube, wherein the groove diameter of the ring die is at least $D_0$ and at most $D_0$+0.1 mm, wherein $D_0$ is the nominal outer diameter of the tube being bent.

2. A method according to claim 1 wherein the groove diameter of the ring die is at least $D_0$+ 0.02 mm.

3. A method according to claim 8 wherein the groove diameter is at most $D_0$+ 0.1 mm—(tube outer diameter after bending—groove diameter) when the tube outer diameter measured in a direction perpendicular to the bending plane of a tube being bent is greater than the groove diameter.

4. A tube bending method comprising:

preparing a plurality of flexible dies of differing basic radius, each die each having a section missing in its periphery permitting radial elastic deformation and having a die groove extending in a circumferential direction of its outer periphery, the die groove having a cross-sectional shape corresponding to an external shape of a tube to be bent, the groove diameter decreasing as the basic radius of the ring dies increases;

deforming at least one of the ring dies to a plurality of different bending radii; and bending a different tube around the deformed ring die at each bending radius to form a U-shaped portion in the tube, wherein the groove diameter is at least the nominal outer diameter $D_0$ of a tube being bent and at most $D_0$+0.1 mm when a bending radius R of the tube $\geqq D_0 \times 80$.

5. A method according to claim 4 wherein the diameter of each groove is at least $D_0$+0.02 mm.

6. A tube bending apparatus comprising:

a flexible ring die having a section missing from its periphery and a die groove extending circumferentially along its outer periphery and having a cross-sectional shape corresponding to an external shape of a tube to be bent; and a holder for holding the ring die on an outer periphery of the holder.

7. A tube bending apparatus according to claim 6 wherein said holder has a generally conical portion and a helical external thread formed on an outer surface of the conical portion, and the tube bending apparatus further comprises:

means for moving the holder in an axial direction and a circumferential direction of the holder;

a ring die having a portion missing from its circumference to permit radial expansion and contraction of the ring die and having an internal thread for engagement with the external thread of the holder, and a groove formed in an outer periphery of the ring die and extending in a circumferential direction of the ring die, the groove having a cross section corresponding to an external shape of a tube to be bent; and a clamping head having a groove opposing the groove in the ring die, the head being movable in the radial direction of the holder to releasably clamp a tube to be bent between the groove in the ring die and the groove in the head and movable in the circumferential direction of the holder to wrap a tube to be bent around the groove in the ring die.

* * * * *